US006750834B2

(12) United States Patent
Shen

(10) Patent No.: US 6,750,834 B2
(45) Date of Patent: Jun. 15, 2004

(54) MODIFICATION OF THE V-T CURVE OF AN LCD BY CHANGING THE WAVEFORM OF COMMON VOLTAGE

(75) Inventor: Yuhren Shen, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 218 days.

(21) Appl. No.: 09/940,289

(22) Filed: Aug. 27, 2001

(65) Prior Publication Data

US 2002/0180681 A1 Dec. 5, 2002

(30) Foreign Application Priority Data

May 31, 2001 (TW) ..... 90113517 A

(51) Int. Cl.[7] ..... G09G 3/36
(52) U.S. Cl. ..... 345/87; 245/89; 245/94
(58) Field of Search ..... 348/87, 90, 92, 348/89, 94, 98, 100, 101, 55, 88, 208; 349/33

(56) References Cited

U.S. PATENT DOCUMENTS 5,006,839 A * 4/1991 Fujita ..... 345/97
6,072,455 A * 6/2000 Matsui et al. ..... 345/97
6,535,191 B1 * 3/2003 Miyachi ..... 345/94

* cited by examiner

*Primary Examiner*—Dennis-Doon Chow
(74) *Attorney, Agent, or Firm*—Birch, Stewart, Kolasch & Birch, LLP

(57) ABSTRACT

A method of modifying a driving voltage to the transparency curve (V-T curve) of a liquid crystal display having a plurality of pixels having a transistor and a liquid crystal capacitor connected to a common electrode. Applying a voltage waveform to the common electrode, during the front/back porch periods of a driving timing of the liquid crystal display, modifies the driving voltage to the transparency curve of the liquid crystal display.

5 Claims, 5 Drawing Sheets

MODIFICATION OF THE V-T CURVE OF AN LCD BY CHANGING THE WAVEFORM OF COMMON VOLTAGE

BACKGROUND OF THE INVENTION

1. Field of the Invention

The present invention relates to a method of modifying a driving voltage to the transparency curve (V-T curve) of a liquid crystal display (LCD). In particular, the present invention relates to a method of modifying the V-T curve of the LCD by modulating voltage waveform on the common electrode.

2. Description of the Related Art

The V-T curve of a LCD is usually determined by its operating liquid crystal mode (hereafter called LC mode). Usually the V-T curve of the LCD is fixed and cannot be changed.

FIG. 1 (PRIOR ART) shows an example of the V-T curve of the LCD. There is a threshold voltage $V_{th}$ in the V-T curve. If the driving voltage is lower than the threshold voltage $V_{th}$, the LC molecules can not incur any reorientation. Under this situation, the change of the driving voltage cannot adjust the optical transparency rate T of the LCD. In addition, the LCD cannot be operated when the driving voltage is lower than the threshold voltage $V_{th}$.

In FIG. 1, the range of the effective operating voltage is between voltage $V_{th}$ and voltage $V_0$.

It is known that the output voltage of a data driver applied in a typical LCD is limited. Therefore, the higher the threshold voltage $V_{th}$, the narrower the effective operating voltage range of the data driver. In addition, it shrinks the physical voltage range with respect to the various gray levels. Accordingly, it is difficult to divide gray levels and the number of effective gray levels of the LCD decreases. For example, when uniformly dividing 1.5V effective operating voltage range into 8 bits (256 levels) of gray levels, the average interval between two gray levels is only 5.86 mV. If the output noise of the data driving IC is 10 mV, the LCD can merely display 128 gray levels corresponding to 7 bits or lower.

Under a fixed output noise level, therefore, to obtain better performance of effective gray levels by the LCD, we must enlarge the effective operating voltage range of the data driving IC.

SUMMARY OF THE INVENTION

To solve the problem found in the prior art, the present invention provides a method of modifying the V-T curve of LCD. By changing the voltage waveform of the common electrode, it is possible to control the V-T curve of the LCD and the value of the threshold voltage ($V_{th}$). By this method, the range of the effective working voltage of the data driving IC in the LCD can be enlarged.

Accordingly, the present invention provides a method of modifying the V-T curve of the LCD. This LCD has a plurality of pixels. Each pixel has liquid crystal and a transistor. The drain terminal of the transistor is connected to a data line. The gate terminal of the transistor is connected to a scan line. The source terminal of the transistor is further connected to a first electrode of one side of the liquid crystal having a second electrode at the other side connecting to a common electrode. A characteristic of the present invention is provision of a changed voltage waveform to the common electrode to modify the V-T curve of the LCD such that the threshold voltage of a data driving IC is reduced and the range of a working voltage is increased.

Furthermore, the method of this present invention mainly changes the voltage waveform of the common electrode during the front porch and the back porch of a driving sequence of the LCD. For example, the amplitude of the changed voltage waveform is in the same or inverse phase and smaller than the amplitude of a positive and negative square wave of a data voltage waveform. Besides, the amplitude of the changed voltage waveform is in the same or inverse phase and greater than the amplitude of a positive and negative square wave of a data voltage waveform.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
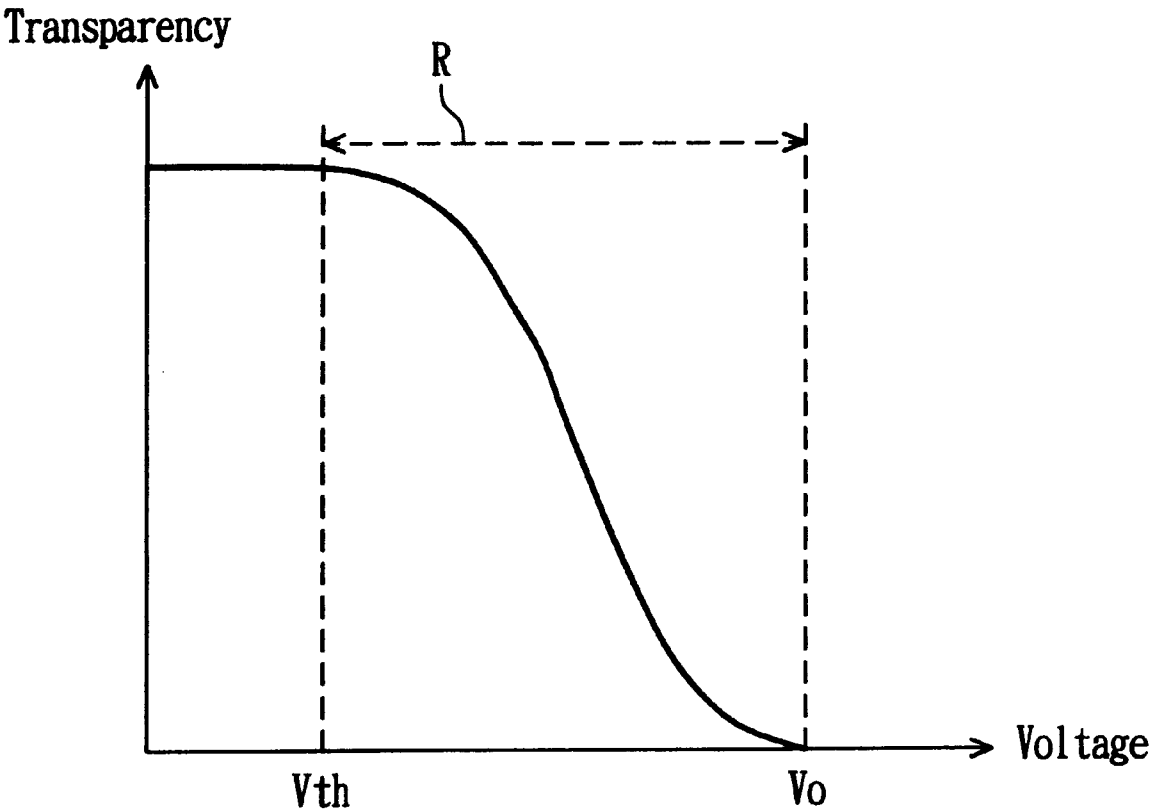
FIG. 1 (PRIOR ART)
FIG. 1 (Prior Art) is a diagram of the driving voltage to transparency (V-T) curve of a typical LCD.
Figure 2:
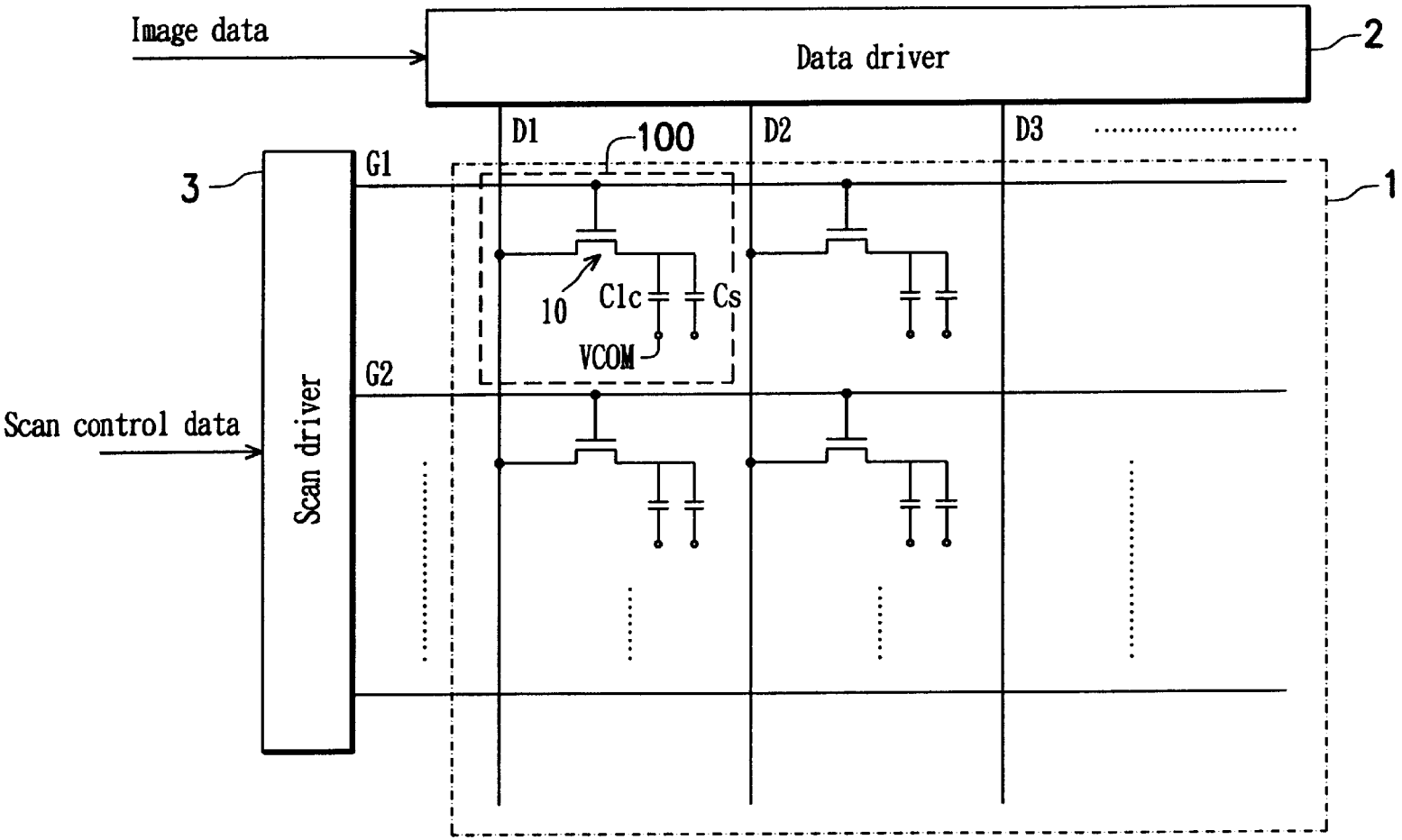
FIG. 2 (PRIOR ART)
FIG. 2 (Prior Art) is a schematic structural diagram of a typical LCD penal.

FIG. 2 is a schematic structural diagram of a typical LCD panel. In FIG. 2, a typical LCD panel has a plurality of pixels 100 arranged in an array structure. Each pixel 100 mainly includes a liquid crystal capacitor $C_{lc}$ of LC molecules, a control transistor 10 and a storage capacitor $C_s$. The drain terminal and the gate terminal of the control transistor 10 are connected to data lines (denoted by D1, D2 . . . ) and scan lines (denoted by G1, G2 . . . ), respectively. The source terminal of the control transistor 10 is connected to a first electrode at one side of the liquid crystal capacitor $C_{lc}$. A second electrode at another side of the LC capacitor $C_{lc}$ is connected to a common electrode Vcom. Furthermore, the data lines and the scan lines are coupled to a data driver 2 and a scan driver 3, respectively. These data lines and scan lines are used to control the pixels according to image data and scanning control data.

The present invention provides a method of mainly modulating the voltage waveform of the common electrode $V_{com}$ in order to modify the V-T curve of the LCD. In the present invention, we can control the threshold voltage $V_{th}$ to enlarge the range of the effective operating voltage of the data driver 2. The detailed driving method of the typical LCD in the preferred embodiment is described.

Figure 3:
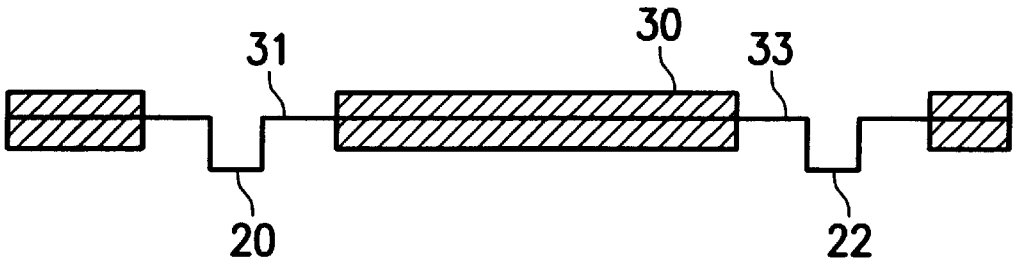
FIG. 3 is a diagram of a driving time sequence of a typical TFT-LCD.

FIG. 3 is a timing diagram showing the driving of a typical TFT-LCD. In FIG. 3, there are mainly two vertical synchronizing signals 20 and 22. Between the two vertical synchronizing signals 20 and 22, there are a data enable period 30, a front porch period 31 and a back porch period 33. Because the data is written during the data enable period 30 by comparing with the voltage applied on the common electrode $V_{com}$, the voltage applied on the common electrode $V_{com}$ cannot be changed at this time. In other words, the voltage waveform applied on the common electrode $V_{com}$ can only be modulated during the front porch period 31 and the back porch period 33. Because the data does not change during the front porch period 31 and the back porch period 33, we can modulate the voltage waveform applied on the common electrode $V_{com}$ during these periods. Using the feedthrough effect produced by capacitors, we can apply various modulated waveforms on the LC capacitor.

Figure 4:
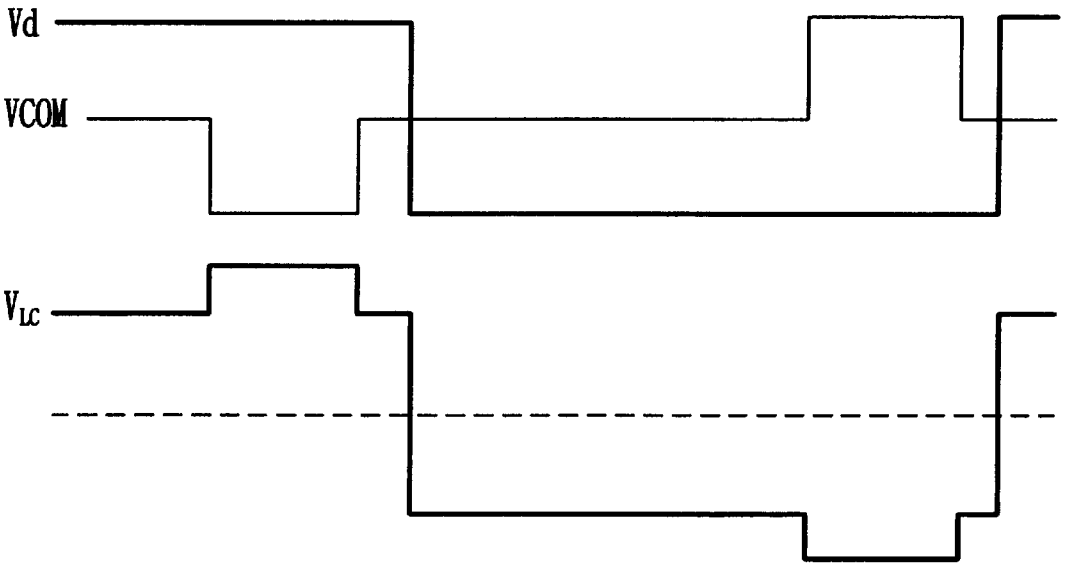
FIG. 4 is a diagram of the voltage waveform changed on the common electrode ($V_{com}$), the data line and the voltage waveform across liquid crystal ($C_{lc}$) of the embodiment in the present invention.

FIG. 4 is a diagram showing the voltage on the common electrode $V_{com}$ and the data line and the voltage across the liquid crystal capacitor $C_{lc}$ in the embodiment of the present invention. In FIG. 4, the driving voltage $V_d$ of the data line is transmitted through the control transistor 10 to the electrode at one side of the liquid crystal capacitor $C_{lc}$. During the front porch period 31 and the back porch period 33, the voltage waveform of the common electrode $V_{com}$, a square waveform, is applied to the electrode at another side of the liquid crystal capacitor $C_{lc}$. Therefore, we can modulate the voltage waveform $V_{lc}$ applied on liquid crystal molecules.

As mentioned above, by modulating voltage waveform of the common electrode, we can control voltage waveform $V_{lc}$ applied on the liquid crystal molecules. Since the liquid crystal molecules are driven by AC voltages, there are various possible voltage waveforms that can be used. According to the preferred embodiment of the present invention, some possible voltage waveforms that can be applied on the common electrode $V_{com}$ are illustrated. FIGS. 5A through 5D are diagrams of some modified voltage waveforms across the liquid crystal capacitor when different voltage waveforms are applied on the common electrode $V_{com}$.

Figure 5C:
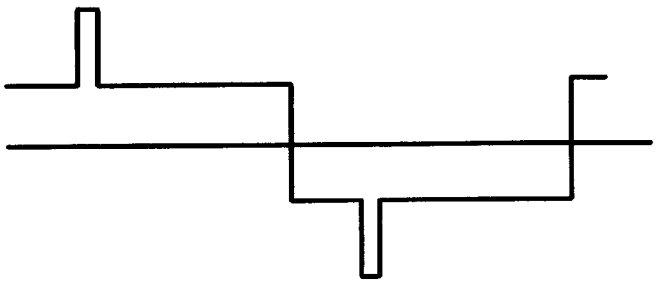
FIGS. 5A through 5D show the modified voltage waveform across liquid crystal when a changed voltage waveform is provided to the common electrode ($V_{com}$)
Figure 5A:
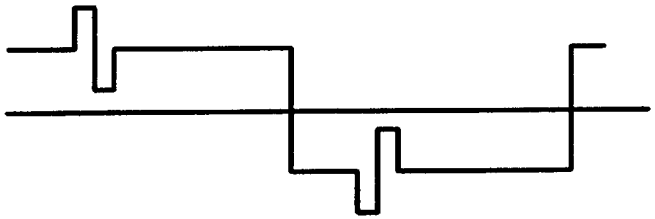

In FIG. 5A, the voltage waveform applied to the common electrode $V_{com}$ is a positive/negative bi-phase square wave.

Figure 5B:
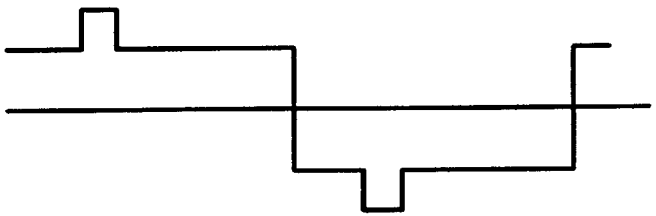

In FIG. 5B, the voltage waveform applied to the common electrode $V_{com}$ is a square wave. The amplitude of the modulation voltage waveform is smaller than that of the data voltage and both are in phase. More specifically, the phase of the modulation voltage waveform applied to the common electrode $V_{com}$ is positive when the data voltage waveform is also positive.

In FIG. 5C, the voltage waveform applied to the common electrode $V_{com}$ is also a square wave. The amplitude of the modulation voltage waveform is greater than that of the data voltage and both are in phase.

Figure 5D:
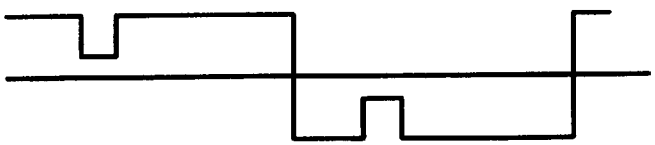

In FIG. 5D, the voltage waveform applied to the common electrode $V_{com}$ is a square wave. The amplitude of the modulation voltage waveform is less than that of the data voltage and both are out of phase.

Figure 6:
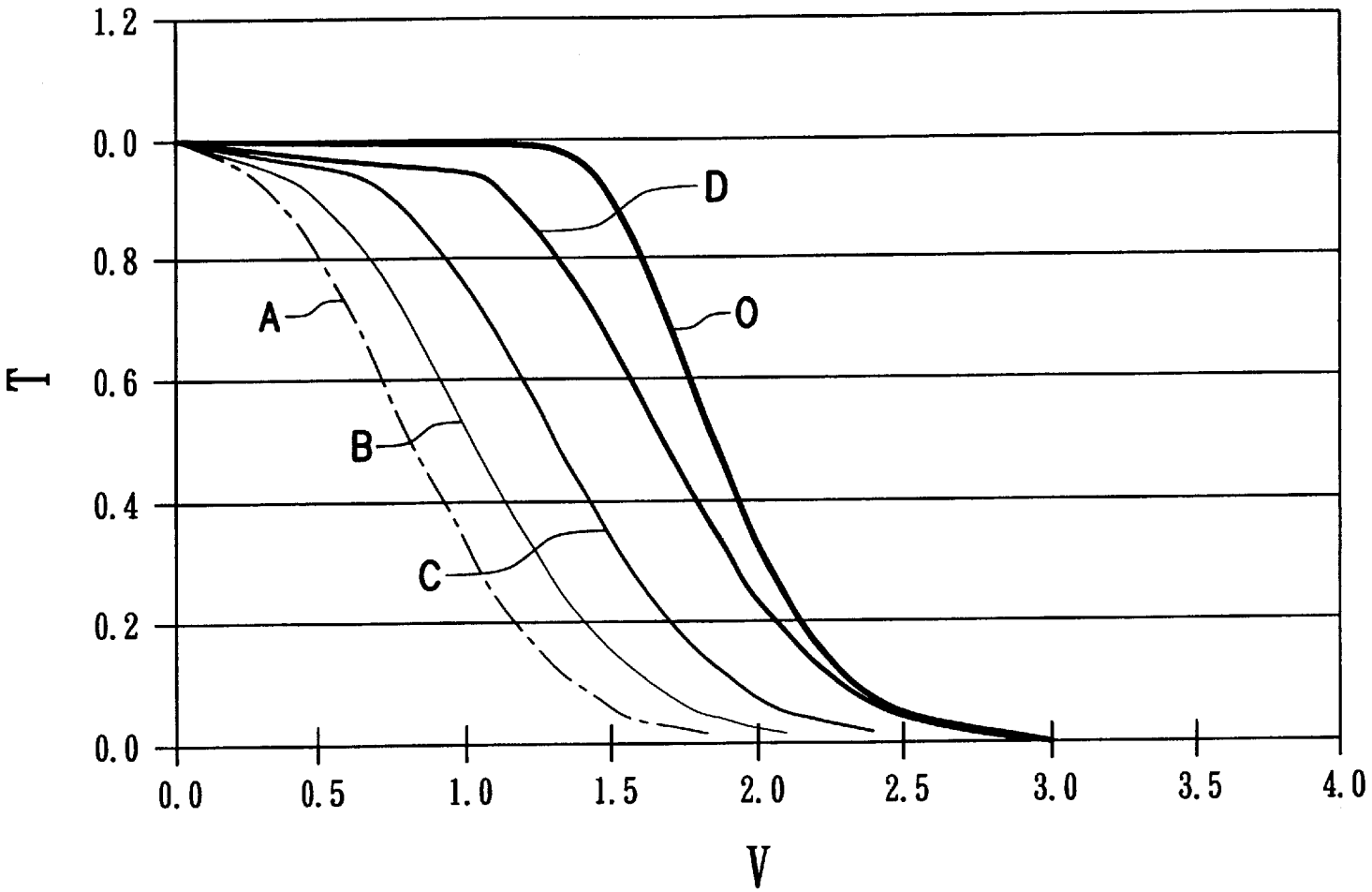
FIG. 6 shows the modified V-T curves, produced by the numeric analysis of different changed voltage waveforms in the embodiment of the present invention.

By using the voltage waveforms mentioned above, after numeric analysis, the modified V-T curves of the LCD can be acquired by the numerical analysis and shown in FIG. 6.

In FIG. 6, curve 0 is a non-modified V-T curve when there is no modulation voltage waveform applied to the common electrode $V_{com}$. Curve A is a modified V-T curve when the modulation voltage waveform shown in FIG. 5A is applied to the common electrode $V_{com}$. Curve B is a modified V-T curve when the modulation voltage waveform shown in FIG. 5B is applied to the common electrode $V_{com}$. Curve C is a modified V-T curve when the modulation voltage waveform shown in FIG. 5C is applied to the common electrode $V_{com}$. Curve D is a modified V-T curve when the modulation voltage waveform shown in FIG. 5D is applied to the common electrode $V_{com}$.

As shown in FIG. 6, when a modulation voltage waveform is used to modulate the common electrode $V_{com}$, the threshold voltage is reduced and the range of the operating voltage is increased. Accordingly, the objective of the present invention is achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of modifying a driving voltage to transparency curve (V-T curve) of a liquid crystal display having a plurality of pixels, each pixel having a liquid crystal component and a transistor, a drain and a gate of the transistor being connected to a data line and a scan line, respectively, a source of the transistor being connected to a first electrode of the liquid crystal component, a second electrode of the liquid crystal component being connected to a common electrode, comprising a step of:

applying a modulation voltage waveform to the common electrode to modify the V-T curve of the liquid crystal display, thereby reducing a threshold voltage of a data driver corresponding to the liquid crystal display and increasing the range of operating voltages of the liquid crystal display, wherein the modulation voltage waveform is applied during a front porch period and a back porch period of a driving timing of the liquid crystal display.

2. The method as claimed in claim 1, wherein the modulation voltage waveform is a bi-phase square wave and the amplitude of the modulation voltage waveform is less than that of a data voltage waveform.

3. The method as claimed in claim 1, wherein the amplitude of the modulation voltage waveform is less than that of a data voltage waveform and the modulation voltage waveform and the data voltage waveform are in phase.

4. The method as claimed in claim 1, wherein the amplitude of the modulation voltage waveform is less than the amplitude of a data voltage waveform and the modulation voltage waveform and the data voltage waveform are out of phase.

5. The method as claimed in claim 1, wherein the amplitude of the modulation voltage waveform is greater than that of a data voltage waveform and the modulation voltage waveform and the data voltage waveform are in phase.

* * * * *